US010981079B1

(12) United States Patent
Goepfert

(10) Patent No.: US 10,981,079 B1
(45) Date of Patent: Apr. 20, 2021

(54) FOG MACHINE

(71) Applicant: John R. Goepfert, Janesville, WI (US)

(72) Inventor: John R. Goepfert, Janesville, WI (US)

( * ) Notice: Subject to any disclaimer, the term of this patent is extended or adjusted under 35 U.S.C. 154(b) by 0 days.

(21) Appl. No.: 16/448,616

(22) Filed: Jun. 21, 2019

Related U.S. Application Data

(60) Provisional application No. 62/687,924, filed on Jun. 21, 2018.

(51) Int. Cl.
*A63J 5/00* (2006.01)
*A63J 5/02* (2006.01)
*F41H 9/06* (2006.01)

(52) U.S. Cl.
CPC ..... *A63J 5/025* (2013.01); *F41H 9/06* (2013.01)

(58) Field of Classification Search
CPC ..... A61L 9/02; A61L 9/03
USPC ..... 239/136
See application file for complete search history.

(56) References Cited

U.S. PATENT DOCUMENTS 5,724,824 A * 3/1998 Parsons ..... B60H 1/3202 62/171
6,189,805 B1 * 2/2001 West ..... B05B 1/20 239/152
7,086,920 B2 * 8/2006 Fusco ..... A63H 33/28 446/15
8,628,029 B2 * 1/2014 Munn ..... B05B 7/241 239/339
2003/0202785 A1 * 10/2003 Monitto ..... F41H 9/06 392/399
2010/0133354 A1 * 6/2010 Vandoninck ..... A63J 5/025 239/14.1
2011/0121092 A1 * 5/2011 Scully ..... A63J 5/025 239/11

* cited by examiner

*Primary Examiner* — Viet Le

(74) *Attorney, Agent, or Firm* — Craig A. Fieschko, Esq.; DeWitt LLP

(57) ABSTRACT

A fog machine supplies air to a fog liquid reservoir to force the fog liquid into a heater, wherein the fog liquid vaporizes to produce fog. The fog liquid supply to the heater can be halted, and the air supply can then be used to purge the heater of residual fog liquid. Within the heater, the fog liquid travels from outer passages further from the heating element(s) to inner passages closer to the heating element(s), whereby the fog liquid is preheated prior to vaporization, resulting in a higher degree of vaporization and "drier" fog with finer vapor particles. The fog machine may draw fog liquid from an "offboard" fog liquid reservoir, such as an off-the-shelf jug of liquid, and is preferably remote-controllable via a user's smartphone.

18 Claims, 3 Drawing Sheets

FOG MACHINE

CROSS-REFERENCE TO RELATED APPLICATIONS

This application claims priority under 35 USC § 119(e) to U.S. Provisional Patent Application 62/687,924 filed Jun. 21, 2018, the entirety of which is incorporated by reference herein.

FIELD OF THE INVENTION

This document concerns an invention relating generally to fog machines (also known as smoke machines) for generating artificial fog/smoke for entertainment use, for use in making special theatrical effects, for fire and tactical training, and for other use.

BACKGROUND OF THE INVENTION

Commonly available fog machines typically have a rectangular box-like structure containing a liquid pump that pumps "fog liquid"—typically a glycol-based or glycerin-based liquid—into a heating coil to generate a visibly dense and lingering vapor (i.e., "fog" or "smoke"). These known fog machines tend to have one or more of the following drawbacks.

First, if a conventional fog machine is left unattended and runs out of liquid, the liquid pump typically keeps running, and can burn out. At that stage it needs to be replaced, or more typically, the machine is discarded.

Second, when operation of conventional fog machines is halted—terminating heating of their heating coils—residual unvaporized fog liquid tends to remain in the coil, and/or fog liquid condenses within the coil. This can then lead to subsequent draining/dripping of fog liquid, particularly if the fog machine is moved. This is at best inconvenient, and at worst dangerous if the fog liquid is still hot.

Third, over time, the heating coil tends to accumulate mineral deposits from fog liquid, particularly where the fog liquid is left resting in the coil. Once blocked, the coils are difficult to cost-effectively clean, and the machine is basically irreparable and is discarded.

Fourth, prior machines typically heat to a single predetermined/preset target temperature, and then cycle on and off via a thermostat. The preset temperature may not be optimal for a particular fog liquid's composition (i.e., the desired amount and/or quality of the fog might be improved if a different target temperature could be set). Moreover, if fog liquid is heated to an improper temperature—for example, where glycol-based fog liquids are overheated—they can generate noxious compounds (e.g., formaldehyde).

SUMMARY OF THE INVENTION

The invention involves a fog machine which is intended to at least partially solve the aforementioned problems. To give the reader a basic understanding of some of the advantageous features of the machine, following is a brief summary of an exemplary version, with reference being made to the accompanying drawings (which are briefly reviewed in the following "Brief Description of the Drawings" section of this document) to assist the reader's understanding. Since the following discussion is merely a summary, it should be understood that more details regarding exemplary versions of the machine may be found in the Detailed Description set forth later in this document. The claims set forth at the end of this document then define the various versions of the invention in which exclusive rights are secured.

The accompanying FIGS. 1 and 2 depict an exemplary assembled fog machine 100, with FIG. 3 then providing a simplified schematic depiction of components of the fog machine 100 connected to a separate external fog liquid reservoir 200. The depicted components include, in major part, an air supply 102, a heater 104, and electronics 106. The air supply 102 (e.g., an air pump or compressed gas container) is configured to supply pressurized air to a connected air supply conduit 108 which has a length opening onto the fog liquid reservoir 200 at a location closer to the top of the fog liquid reservoir 200 than the bottom of the fog liquid reservoir 200. A liquid supply conduit 110 is then provided to supply liquid from the fog liquid reservoir 200 to the heater 104, wherein the liquid supply conduit 110 has an liquid conduit opening 112 situated closer to the bottom of the fog liquid reservoir 200 than the top of the fog liquid reservoir 200. Thus, when the air supply 102 supplies air to the fog liquid reservoir 200, the pressurized air collecting at the top of the fog liquid reservoir 200 tends to push the fog liquid at the bottom of the fog liquid reservoir 200 through the liquid supply conduit 110 to a vaporizing passage in the heater 104 (the vaporizing passage not being visible in FIG. 3, and being discussed at greater length below). The heater 104 has one or more heating elements 114 (e.g., resistive heating elements) which vaporize any fog liquid within the vaporizing passage, producing fog which emits through a fog outlet 116 (FIGS. 2 and 3) following the vaporizing passage. Because the fog liquid is driven via air pressure from the air supply 102, rather than via a liquid pump, the fog machine 100 avoids the possibility of burn-out of a liquid pump if/when the fog liquid reservoir 200 runs dry.

The fog machine 100 also includes an arrangement which reduces or eliminates the problem of residual fog liquid within the fog machine 100 during shut-down. A purging conduit 118 extends between the air supply 102 and the vaporizing passage of the heater 104 (more preferably, to the liquid supply conduit 110 upstream from the vaporizing passage), whereby the air supply 102 can "blow out" the vaporizing passage and eliminate residual fog liquid. A liquid supply valve 120 is situated along the liquid supply conduit 110 upstream from the vaporizing passage, with actuation of the liquid supply valve 120 (i.e., its opening and closing) being controlled by the electronics 106 (as by the electronics' sending an appropriate signal to a solenoid or other electromechanical actuator associated with the valve 120). Similarly, an actuatable air supply valve 122 is situated along the purging conduit 118 upstream from the vaporizing passage of the heater 104. When fog generation is to be terminated, the electronics 106 (more particularly a controller included within the electronics 106) can close the liquid supply valve 120, halting supply of fog liquid from the fog liquid reservoir 200 to the vaporizing passage. Then, preferably after the heater 104 is left to run for a short period sufficient to vaporize any fog liquid remaining in its vaporizing passage, the controller 106 opens the air supply valve 122, whereby pressurized air is supplied through the purging conduit 118 to and through the vaporizing passage, ejecting the remaining (and vaporized) fog liquid from the fog outlet 116.

Preferably, a liquid check valve 124 is situated along the liquid supply conduit 110 between the vaporizing passage and the liquid supply valve 120 (e.g., downstream from the liquid supply valve 120 and upstream from the purging conduit 118) to prevent backflow of fog liquid via back pressure from the vaporizing fog liquid within the vaporizing passage. Similarly, an air check valve 126 is preferably situated along the purging conduit 118 between the air supply valve 122 and the vaporizing passage (e.g., downstream from the air supply valve 122 and upstream from the liquid supply conduit 110) to prevent fog liquid from traveling along the purging conduit 118 toward the air supply 102.

The heater 104 is depicted in FIG. 3 as a thermally conductive mass (e.g., a metal block) formed in two sections, with a first (lower) section 104L having the heating elements 114 inserted therein, and a second (upper) section 104U receiving fog liquid from the liquid supply conduit 110. FIGS. 4A and 4B then illustrate exemplary inner faces 128L and 128U of the first heater section 104L (FIG. 4A) and second heater section 104U (FIG. 4B), wherein the inner faces 128L and 128U have floors 130L and 130U depressed within borders 132L and 132U at which the inner faces 128L and 128U mate, and wherein the vaporizing passage 134L and 134U is defined as a sinuous channel depressed within the floors 130L and 130U. Not depicted is a rectangular gasket which fits within the borders 132L and 132U and between the floors 130L and 130U when the sections 104L and 104U are joined, thereby closing and separating the vaporizing passage portions 134L and 134U within the heater 104. The fog liquid urged through the liquid supply conduit 110 thereby enters the second (upper) section 104U to travel along the sinuous vaporizing passage 134U therein, which is spaced further from the heating elements 114 than the sinuous vaporizing passage 134L within the first section 104L, and which therefore defines a preheating path 134U which warms the fog liquid before entering the hotter portion of the vaporizing path 134L within the first section 104L. The lengths of the preheating path 134U of the second (upper) section 104U extend at least substantially perpendicularly to the lengths of the vaporizing passage 134L within the first section 104L, assisting with preheating via heat transfer from the first section 104L. Upon exiting the preheating path 134U, the preheated fog liquid then travels through a juncture 136 (FIG. 3) to travel through the vaporizing path 134L within the first section 104L, exiting at the fog outlet 116 as fog. This arrangement, wherein the vaporizing passage 134L/134U (collectively referred to as the vaporizing passage 134) is defined in a monolithic thermally conductive mass, and has an "outer" preheating path 134U spaced further from the heating elements 114 than the remainder of the vaporizing passage at 134L, has been found to result in more even/steady vaporization temperature, and more even fog production, than in prior fog machines using heated coils.

The exemplary fog machine 100 depicted in the drawings is adapted for use of an external (offboard) fog liquid reservoir 200, though an onboard reservoir could alternatively or additionally be used. In particular, as seen in FIG. 3, the fog machine 100 is adapted for use of a conventional off-the-shelf container of fog liquid, such as a gallon bottle having a threaded neck 202 and screw-top cap (not shown), as a fog liquid reservoir 200. The fog machine 100 preferably has a housing 138 (best shown in FIGS. 1 and 2) which encloses the air supply 102 and heater 104, and flexible portions 108F and 110F of the air supply conduit 108 and liquid supply conduit 110—shown in FIG. 3 as tubing installed over nozzles at the ends of rigid portions of the conduits 108 and 110—extend from the exterior of the housing 138, and preferably have lengths which are at least as great as the major dimension of the housing 138. This arrangement allows the fog machine 100 to be easily carried from location to location without the added weight of a liquid-filled onboard reservoir, and allows for versatility in the fog machine's placement/location, as it may operate at a variety of orientations with a distantly-located fog liquid reservoir 200. Furthermore, this arrangement avoids a common drawback of conventional fog machines that require that their onboard fog liquid reservoirs be filled carefully (typically with a funnel) to avoid spillage and mess.

Further potential advantages, features, and objectives of the invention will be apparent from the remainder of this document in conjunction with the associated drawings.

DETAILED DESCRIPTION OF EXEMPLARY VERSIONS OF THE INVENTION

Figure 1:
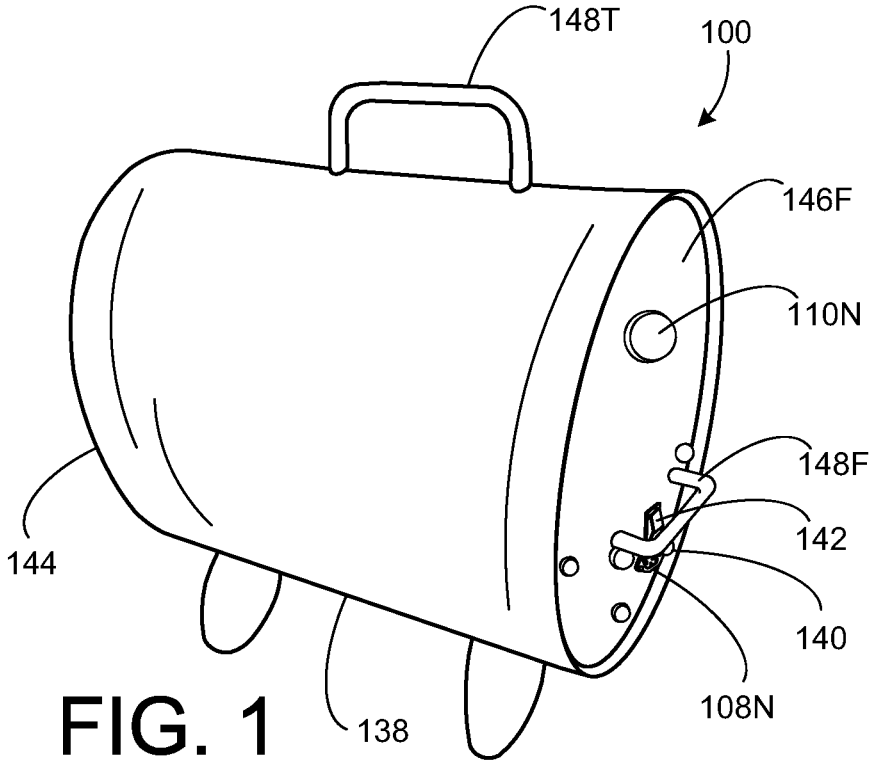
FIG. 1 is a front perspective view of an exemplary fog machine 100.

Expanding on the discussion above, the exemplary fog machine 100—more particularly, its electronics 106 (FIG. 3)—is electrically powered via a power cord (with a power jack 140 for installation of an external electrical cord being shown in FIG. 1), and/or via onboard batteries, and may be activated/deactivated) by an on/off switch 142. The electronics 106 may include conventional components which are not depicted individually in the drawings, such as an AC-to-DC power converter or other power conditioners, one or more fuses, etc. as needed. Components which are not individually depicted, but which are particularly preferred, include one or more temperature sensors (e.g., thermocouples, thermistors, etc.) provided in or on the heater 104 for purpose of temperature measurement, and a controller in communication with the temperature sensor(s) which is configured to control the heating element(s) 114 in response to the sensors' temperature measurements. As will be discussed at greater length below, the controller is preferably capable of wireless remote control, allowing a user to control operation of the fog machine 100 via a smartphone or other device capable of communication with the controller.

Figure 2:
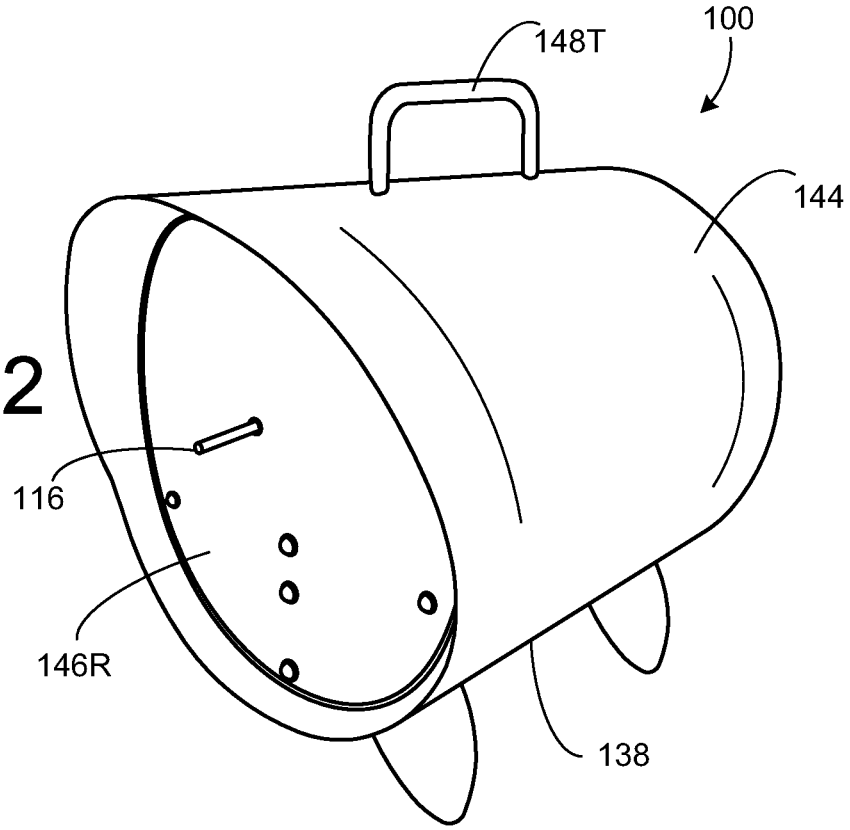
FIG. 2 is a rear perspective view of the fog machine 100 of FIG. 1.

As seen in FIGS. 1 and 2, the housing 138 has a generally cylindrical housing body 144 with circular housing ends 146F and 146R, with the housing body 144 bearing a top handle 148T and the front housing end 146F bearing a front handle 148F. As partially seen in FIG. 2, the interior of the housing 138 is horizontally bisected by a platform 150 extending between the ends 146F and 146R, whereupon the air supply 102, electronics 106, and heater 104 are mounted. By removing screws, undoing clips, or otherwise detaching the housing ends 146F and 146R from the housing body 144, the housing ends 146F and 146R and platform 150 (and associated components) can be pulled from the housing body 144 in the manner of a drawer for inspection and maintenance. While not shown in the drawings, the heater 104 (and air supply 102 and electronics 106) may be mounted spaced from the platform 150, with layers of thermal insulation being situated in the resulting space, thereby better protecting the air supply 102 and electronics 106 from the heater 104. Flexible insulation (e.g., fiberglass batt) is also preferably wrapped around/draped over the heater 104.

Figure 3:
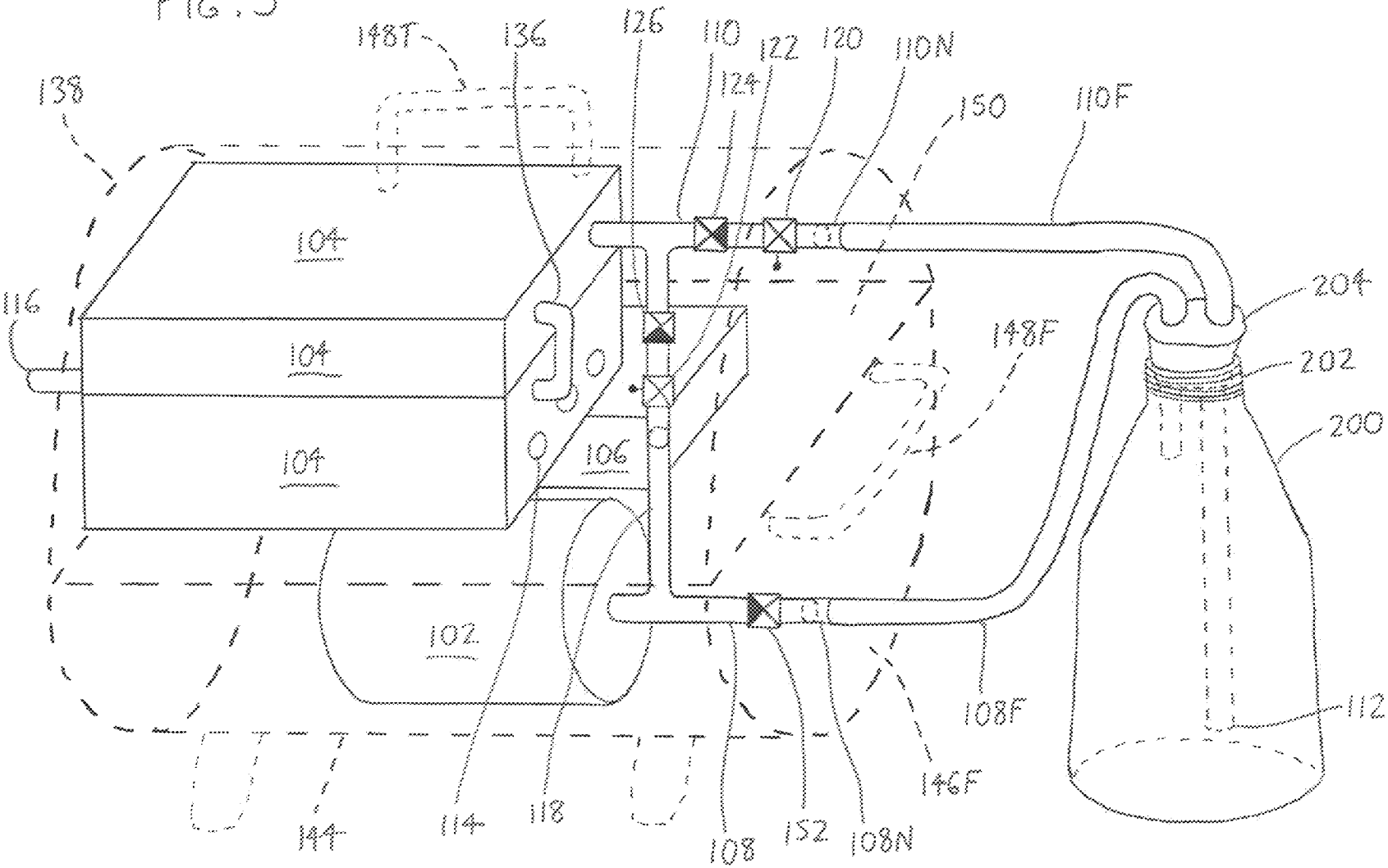
FIG. 3 is a simplified schematic depiction of components of the fog machine 100 of FIGS. 1-2 shown connected to a separate external fog liquid reservoir 200.
Figure 4A:
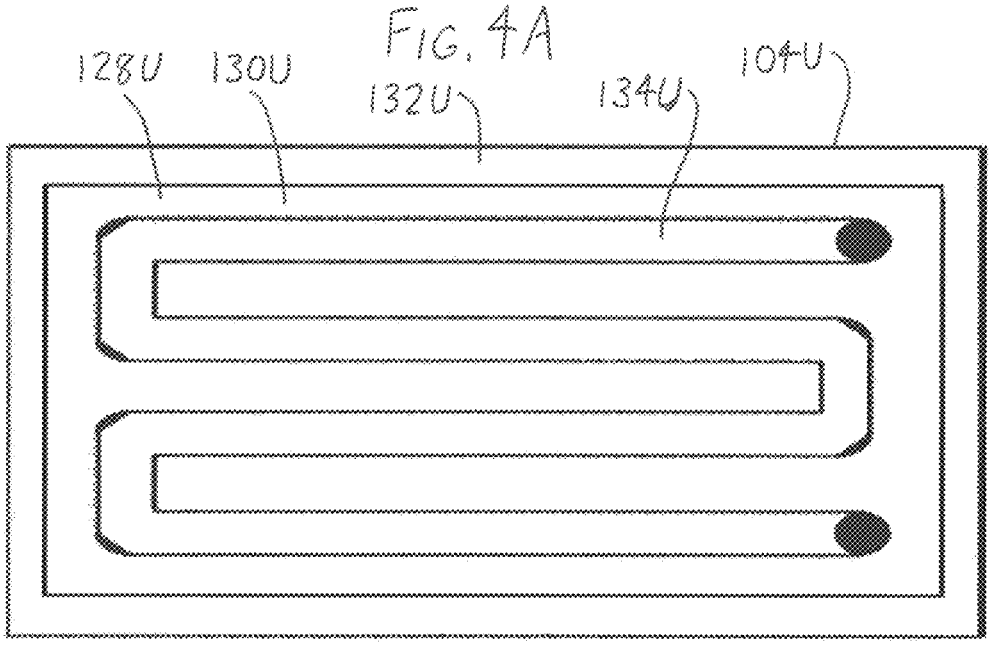
FIGS. 4A and 4B are respectively plan views of the inner faces 128L and 128U of the first heater section 104L (FIG. 4A) and second heater section 104U (FIG. 4B) of the heater 104 of FIG. 3.
Figure 4B:
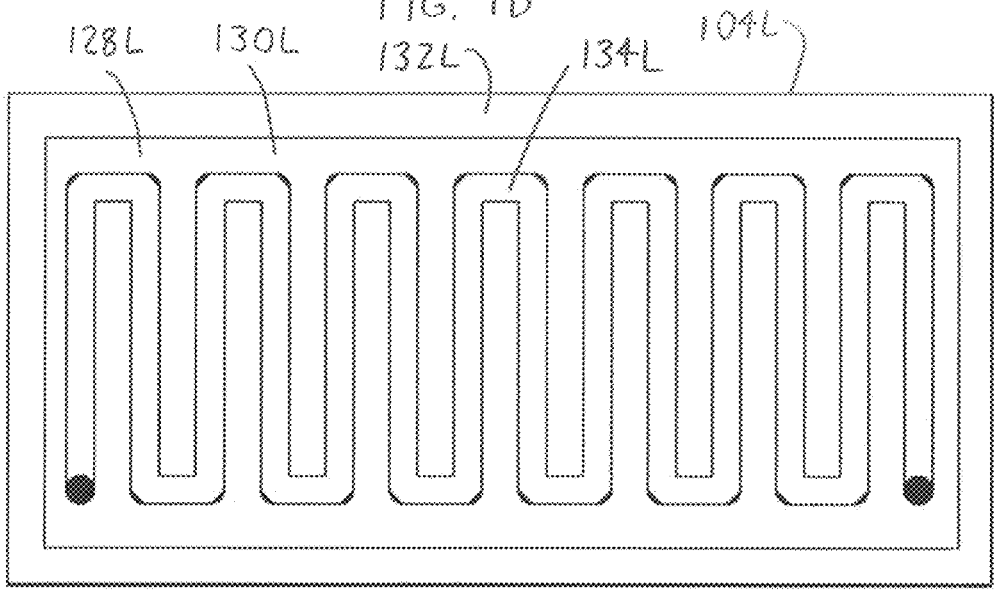

Referring to FIG. 3, the air supply 102 pumps or otherwise supplies air through the rigid portion of the air supply conduit 108 to the air connection nozzle 108N located on the outer surface of the housing 138, where a flexible tube 108F defines the remainder of the air supply conduit 108. A check valve 152 is preferably situated in or upstream the nozzle 108N so that only outward airflow is permitted. The flexible portion 108F of the air supply conduit 108 extends through a frustoconical elastomeric stopper 204 installed atop the fog liquid reservoir 200—depicted as a conventional off-the-shelf jug of fog liquid—to preferably terminate at or near the inserted bottom surface of the stopper 204. The stopper 204 need not have the depicted form, and could instead be a cap which is internally threaded or otherwise configured to seal atop the fog liquid reservoir 200, and which bears or is otherwise configured to receive the conduits 108 and 110 in air-tight fashion. The flexible portion 110F of the liquid supply conduit 110 similarly extends through the stopper 204 to a location at or near the bottom of the fog liquid reservoir 200, such that pressurization of the air at the top of the fog liquid reservoir 200 urges fog liquid into and through the liquid supply conduit 110. The fog liquid flows through the flexible portion 110F of the liquid supply conduit 110 to the liquid connection nozzle 110N located on the front end 146F of the housing 138, at which point the fog liquid enters the rigid portion of the liquid supply conduit 110. The fog liquid then encounters the liquid supply valve 120, which prevents liquid flow until the controller 106 determines (via the temperature sensors associated with the heater 104) that the heater 104 has reached a desired temperature (as discussed below, preferably a user-defined temperature). When the liquid supply valve 120 opens, the fog liquid moves through the liquid check valve 124, which helps to isolate the liquid supply from the fog liquid reservoir 200 from the effects of downstream pressure from vaporizing fog liquid.

The fog liquid then flows into the preheating portion 134U of the vaporizing passage within the second (upper) section 104U of the heater 104, preferably to a temperature near, but not in excess of, the fog liquid's boiling temperature. The preheated fog liquid then enters the vaporizing passage 134L within the first section 104L of the heater 104, wherein it vaporizes and exits the fog outlet 116 as fog. The generated fog is "dryer" than in conventional fog machines (that is, it is more highly vaporized, with less "wet" atomized fog liquid), and it has lower output pressure and less output noise.

As noted above, the controller 106 is preferably capable of wireless remote control, e.g., via commands received by a Bluetooth receiver connected in communication with the controller 106. Most preferably, the commands are provided via an application running on the user's smartphone, whereby the user can program the operation of the fog machine 100 via the application. Alternatively or additionally, the fog machine 100 could be controlled via a dedicated remote control (as well as via onboard controls), and/or via cabled connection to a remote control (e.g., via DMX or CAT-5 controls). Programming options preferably include:

a. System temperature: the user may set the desired heater 104 temperature, thereby customizing the fog machine 100 for the fog liquid being used.

b. Continuous versus intermittent operation: the user may set the fog machine 100 for continuous fog generation, or alternatively for intermittent operation, preferably with user-defined periods of fog generation and/or user-defined rest periods between fog generation periods;

c. Manual burst: by pressing a button or otherwise generating an appropriate signal, the fog machine 100 may immediately generate a burst of fog for the duration of the signal.

When the fog machine 100 is shut off (as by sending a command to the controller 106, or terminating power to the fog machine 100 at the on/off switch 142), the heating elements 114 are turned off and the liquid supply valve 120 closes. The air supply valve 122 is then opened, with the purging conduit 118 delivering air from the air supply 102 to the vaporizing passage 134 and fog outlet 116. The air delivery is maintained for a short period (e.g., ten seconds), effectively removing most or all residual fog liquid from the vaporizing passage 134, and simultaneously cooling the heater 104.

The fog machine 100 can be varied in numerous respects other than any variations noted above. As an example, a heating/cooling system could be provided near the fog outlet 116 to condition the fog, that is, heat or cool the fog to vary its height once emitted (with cooled fog being denser and lower, and heated fog being less dense and higher). A temperature sensor can monitor the ambient air temperature to determine the appropriate heating/cooling setting for the desired fog height.

The fog machine 100 can be sized and configured for vehicle mounting, including on robotic/drone vehicles, so that it may be placed as desired for police/military training or for tactical attack/defense use.

Motion detectors or other presence sensors could be incorporated on or in association with the fog machine 100 such that the machine's operation can be triggered by motion or presence. For example, the fog machine 100 could be programmed to generate fog (or stop generating fog) when motion is detected.

Lighting (e.g., LEDs and/or lasers) could be situated on the fog machine 100 to illuminate the fog, with the illumination's characteristics (e.g., duration, direction, etc.) preferably being user-programmable.

As FIG. 3 is a simplified schematic view of an exemplary arrangement of the fog machine's components, it should be understood that some components (e.g., wiring or other signal-transmitting means between the liquid supply valve 120 and air supply valve 122 to the controller 106) are not shown. Further, the sizes/configurations and locations of components may not correspond to actual and/or preferred arrangements; for example, the liquid check valve 124 is preferably situated along the liquid supply conduit 110 immediately adjacent the purging conduit 118, such that air from the purging conduit 118 more fully purges the liquid supply conduit 110 and the vaporizing passage 134 of leftover fog liquid. Similarly, the air check valve 126 is preferably situated along the purging conduit 118 immediately adjacent the liquid supply conduit 110, such that there is little or no length of purging conduit 118 to receive fog liquid during fog generation (thereby minimizing the need for later purging of fog liquid from the purging conduit 118).

Various terms referring to orientation and position used throughout this document—e.g., "top" (as in "top handle") and "front" (as in "front housing end")—are relative terms rather than absolute ones. In other words, it should be understood (for example) that the top handle being referred to may in fact be located at the side or bottom of the machine depending on the overall orientation of the machine. Thus, such terms should be regarded as words of convenience, rather than limiting terms.

The "major dimension" of an object (e.g., the major dimension of the housing) is the greatest distance between opposing sides of the object, as measured through an axis extending through the geometric center of the object.

The term "pressurized air" should be understood to mean air at greater than ambient pressure.

A "controller" can be any device suitable for executing instructions, such as a microprocessor, a microcontroller, a digital signal processor (DSP), an ASIC (Application-Specific Integrated Circuit), a PLD (Programmable Logic Device), an FPGA (Field Programmable Gate Array), or any other suitable processing device.

When a conduit or other passage is said to extend between a pair of components (such as valves or other conduits/passages), this indicates that the passage is configured to provide fluid between the components (and possibly through other intervening components). When a conduit or other passage is said to be sinuous, this indicates that a liquid traveling along the passage reverses its direction at least twice along a plane, as along a sinusoidal/serpentine, zigzag, or similar path.

When a component (such as a valve) is stated to be along a conduit, this indicates that the component is between the ends of the conduit, or at one of the conduit's ends. When a first component (such as a valve) is stated to be along a conduit upstream from a second component, this indicates that the first component precedes the second along the path conventionally taken by the fluid carried by the conduit. Conversely, when a first component is stated to be along a conduit downstream from a second component, this indicates that the first component follows the second along the path conventionally taken by the conduit's fluid.

When a valve is stated to be a check valve (also known as a one-way valve, non-return valve, retention valve, reflux valve, or clack valve), this indicates that the valve is designed to only allow fluid flow in the direction conventionally taken within the conduit along which the valve is situated. When a valve is stated to be an actuatable valve, this indicates that the valve is activated to open and/or close (either wholly or partially) from application of an external force, and/or receipt of an external signal. For example, a solenoid-actuated valve is an actuable valve, as the solenoid opens and/or closes the valve upon the solenoid's receipt of an appropriate signal.

It should be understood that the versions of the invention described above are merely exemplary, and the invention is not intended to be limited to these versions. Rather, the scope of rights to the invention is limited only by the claims set out below, and the invention encompasses all different versions that fall literally or equivalently within the scope of these claims.

What is claimed is:

1. A fog machine including:

a. an air supply configured to supply pressurized air to a fog liquid reservoir, b. a heater having:

(1) a heating element, and (2) a vaporizing passage, wherein heat from the heating element vaporizes any fog liquid within the vaporizing passage, c. a housing at least substantially enclosing the air supply and heater, d. an air supply conduit:

(1) connected to the air supply within the housing, and (2) having a length:

(a) extending from the exterior of the housing, and (b) which is at least as great as the major dimension of the housing, e. a liquid supply conduit configured to supply liquid from the fog liquid reservoir to the vaporizing passage of the heater, wherein an external portion of the liquid supply conduit:

(1) extends from the exterior of the housing, and (2) has a length at least as great as the major dimension of the housing.

2. The fog machine of claim 1 further including a purging conduit extending between the air supply and the liquid supply conduit.

3. The fog machine of claim 2 further including a liquid check valve situated along the liquid supply conduit upstream from the purging conduit.

4. The fog machine of claim 3 further including an actuatable liquid supply valve situated along the liquid supply conduit upstream from the liquid check valve.

5. The fog machine of claim 2 further including an air check valve situated along the purging conduit upstream from the liquid supply conduit.

6. The fog machine of claim 5 further including an actuatable air supply valve situated along the purging conduit upstream from the air check valve.

7. The fog machine of claim 1 further including:

a. an actuatable liquid supply valve situated along the liquid supply conduit upstream from the vaporizing passage, b. a purging conduit extending between the air supply and the vaporizing passage, c. an actuatable air supply valve situated along the purging conduit upstream from the vaporizing passage, d. a controller configured to:

(1) close the liquid supply valve following supply of liquid from the fog liquid reservoir to the vaporizing passage, then (2) open the air supply valve, whereby pressurized air is supplied through the purging conduit to the vaporizing passage.

8. The fog machine of claim 7 further including:

a. a liquid check valve situated along the liquid supply conduit upstream from the vaporizing passage, and b. an air check valve situated along the purging conduit upstream from the vaporizing passage.

9. The fog machine of claim 7 wherein the vaporizing passage includes:

a. a sinuous path within the heater, and b. a preheating path:

(1) on or within the heater, (2) extending at least substantially perpendicularly to at least a major portion of the sinuous path, and (3) being spaced further from the heating element than the sinuous path.

10. The fog machine of claim 1 further including:

a. the fog liquid reservoir, wherein the liquid supply conduit has an inlet opening situated closer to the bottom of the fog liquid reservoir than the top of the fog liquid reservoir, b. an air supply conduit:

(1) connected to the air supply, and (2) having a length opening onto the fog liquid reservoir at a location closer to the top of the fog liquid reservoir than the bottom of the fog liquid reservoir.

11. The fog machine of claim 1 wherein the fog liquid reservoir has a top opening which:

a. receives the pressurized air from the air supply, and b. bears external threading.

12. The fog machine of claim 11 wherein the liquid supply conduit:

a. extends through the top opening of the fog liquid reservoir, and b. has an inlet opening situated closer to the bottom of the fog liquid reservoir than the top of the fog liquid reservoir.

13. The fog machine of claim 1 wherein the fog liquid reservoir has a top opening which:

a. bears external threading, and a. has the external portion of the liquid supply conduit extending therein.

14. A fog machine including:

a. an air supply configured to supply pressurized air to a fog liquid reservoir, b. a heater having:

(1) a heating element, and (2) a vaporizing passage, wherein heat from the heating element vaporizes any fog liquid within the vaporizing passage, c. a liquid supply conduit configured to supply liquid from the fog liquid reservoir to the vaporizing passage of the heater, wherein the heater includes a thermally conductive mass in which:

a. the heating element is inserted, and b. the vaporizing passage is defined, the vaporizing passage:

(1) being spaced from the heating element within the conductive mass, and (2) having a sinuous path through the conductive mass, and wherein the vaporizing passage further includes a preheating path:

a. in series with the sinuous path, b. spaced further from the heating element than the sinuous path, c. extending:

(1) on or within the conductive mass, and (2) at least substantially perpendicularly to at least a major portion of the sinuous path.

15. The fog machine of claim 14 further including:

a. a liquid check valve situated along the liquid supply conduit upstream from the vaporizing passage, b. an actuatable liquid supply valve situated along the liquid supply conduit upstream from the liquid check valve, c. a purging conduit extending between the air supply and the vaporizing passage, d. an air check valve situated along the purging conduit upstream from the vaporizing passage, and e. an actuatable air supply valve situated along the purging conduit upstream from the air check valve.

16. The fog machine of claim 15 further including a controller configured to:

a. close the liquid supply valve following supply of liquid from the fog liquid reservoir to the vaporizing passage, then b. open the air supply valve, whereby pressurized air is supplied through the purging conduit to the vaporizing passage.

17. A fog machine including:

a. a fog liquid reservoir, b. an air supply configured to supply pressurized air, c. a heater having:

(1) a heating element, (2) a vaporizing passage defining a sinuous path within the heater, wherein heat from the heating element vaporizes any fog liquid within the vaporizing passage, and (3) a preheating path:

(a) in series with the sinuous path, (b) spaced further from the heating element than the sinuous path, and (c) extending:

i. on or within the conductive mass, and ii. at least substantially perpendicularly to at least a major portion of the sinuous path, d. an air supply conduit:

(1) connected to the air supply, and (2) having a length opening onto the fog liquid reservoir at a location closer to the top of the fog liquid reservoir than the bottom of the fog liquid reservoir, e. a liquid supply conduit configured to supply liquid from the fog liquid reservoir to the vaporizing passage of the heater, wherein the liquid supply conduit has an inlet opening situated closer to the bottom of the fog liquid reservoir than the top of the fog liquid reservoir, f. a purging conduit extending between the air supply and the vaporizing passage, g. an actuatable liquid supply valve situated along the liquid supply conduit upstream from the vaporizing passage, h. an actuatable air supply valve situated along the purging conduit upstream from the vaporizing passage, i. a liquid check valve situated along the liquid supply conduit between the vaporizing passage and the liquid supply valve, j. an air check valve situated along the purging conduit between the vaporizing passage and the air supply valve, k. a controller configured to:

(1) close the liquid supply valve following supply of liquid from the fog liquid reservoir to the vaporizing passage, then (2) open the air supply valve, whereby pressurized air is supplied through the purging conduit to the vaporizing passage.

18. The fog machine of claim 17:

a. further including a housing at least substantially enclosing the air supply and heater, b. wherein the fog liquid reservoir is outside of, and spaced from, the housing, c. wherein the liquid supply conduit includes an external portion:

(1) extending from the exterior of the housing to terminate in the inlet opening, and (2) having a length at least as great as the major dimension of the housing, d. wherein the air supply conduit includes an external portion:

(1) extending from the exterior of the housing to open onto the fog liquid reservoir, and (2) having a length at least as great as the major dimension of the housing.

* * * * *